US007038626B2

(12) United States Patent
Gothard et al.

(10) Patent No.: US 7,038,626 B2
(45) Date of Patent: May 2, 2006

(54) BEAMFORMING USING A BACKPLANE AND PASSIVE ANTENNA ELEMENT

(75) Inventors: Griffin K. Gothard, Satellite Beach, FL (US); Kenneth M. Gainey, Satellite Beach, FL (US); Bing Chiang, Melbourne, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 10/348,202

(22) Filed: Jan. 20, 2003
(Under 37 CFR 1.47)

(65) Prior Publication Data

US 2004/0113851 A1 Jun. 17, 2004

Related U.S. Application Data

(60) Provisional application No. 60/350,904, filed on Jan. 23, 2002.

(51) Int. Cl.
*H01Q 1/24* (2006.01)

(52) U.S. Cl. ..... 343/702; 826/833

(58) Field of Classification Search ..... 343/702, 343/826, 893, 908, 833, 834, 872, 841, 829, 343/846, 848
See application file for complete search history.

(56) References Cited

U.S. PATENT DOCUMENTS

| | | | | |
|---|---|---|---|---|
| 3,846,799 A | | 11/1974 | Gueguen | |
| 5,535,435 A | | 7/1996 | Balzano et al. | |
| 5,905,473 A | | 5/1999 | Taenzer | |
| 5,929,823 A | | 7/1999 | Martek et al. | |
| 5,995,052 A | * | 11/1999 | Sadler et al. | 343/702 |
| 6,034,638 A | * | 3/2000 | Thiel et al. | 343/702 |
| 6,246,374 B1 | * | 6/2001 | Perrotta et al. | 343/702 |

(Continued)

FOREIGN PATENT DOCUMENTS

| | | |
|---|---|---|
| DE | 196 00 041 A1 | 6/1996 |
| EP | 902 498 A1 | 3/1999 |
| FR | 2 761 559 A1 | 10/1998 |

OTHER PUBLICATIONS

Ohira and Gyoda, "Electronically Steerable Passive Array Radiator Antennas for Low-Cost Analog Adaptive Beamforming,"0-7803-6345-0/00, 2000 IEEE.

Scott, et al., "Diversity Gain from a Single-Port Adaptive Antenna Using Switched Parasitic Elements Illustrated with a Wire and Monopole Prototype," IEEE Transactions on Antennas and Propagation, vol. 47, No. 6, Jun. 1999.

King, Ronold W.P., *The Theory of Linear Antennas*, pp. 635-637, Harvard University Press, Cambridge, Mass., 1956.

*Primary Examiner*—Trinh Vo Dinh
(74) *Attorney, Agent, or Firm*—Hamilton, Brook, Smith & Reynolds, P.C.

(57) ABSTRACT

An active antenna element to transmit and/or receive RF (Radio Frequency) signals is positioned in relation to a backplane that reflects RF signals. One or more passive antenna elements can be disposed on a similar side of the backplane as the active antenna element. Settings of the one or more passive antenna elements are adjusted to produce an input/output beam pattern that varies depending on whether the at least one passive antenna element is reflective or transmissive. Based on this technique, an RF input output beam pattern of an antenna assembly including the backplane, active antenna element and passive antenna elements can be controlled for better reception and transmission of RF signals.

13 Claims, 10 Drawing Sheets

U.S. PATENT DOCUMENTS 6,369,770 B1 4/2002 Gothard et al.
6,417,806 B1 7/2002 Gothard et al.
6,563,467 B1 * 5/2003 Buris et al. ..... 343/702
2001/0044320 A1 * 11/2001 Ono et al. ..... 455/550
2003/0132884 A1 * 7/2003 Ragner et al. ..... 343/702
2004/0150568 A1 * 8/2004 Chiang et al. ..... 343/702

* cited by examiner

BEAMFORMING USING A BACKPLANE AND PASSIVE ANTENNA ELEMENT

RELATED APPLICATIONS

This application claims the benefit of U.S. Provisional Application No. 60/350,904 filed on Jan. 23, 2002, entitled "Beamforming Using a Reflective Backplane and Passive Antenna Element", the entire teachings of which are incorporated herein by reference.

BACKGROUND OF THE INVENTION

Cellular phones are continuously being reduced in size to enhance portability. For example, today's smallest available cellular phone device can conveniently fit in a person's pocket or clip easily onto a belt. The limit in size appears to be a cellular phone having dimensions similar or even smaller than those of a credit card so that it will fit in a wallet.

So much emphasis has been placed on reducing cell phone size that antenna gains of corresponding cell phone antennas are surprisingly poor. Typically, antenna gains of smaller cellular phones are −3 dBi or even lower. Antennas used in these phones, therefore, generally do not have the ability to mitigate the effects of interference or reduce fading. Consequently, the quality of communication can suffer as a result of reduced cell phone size.

U.S. Pat. No. 5,905,473 discloses an adjustable antenna having an active antenna element and multiple passive antenna elements that reflect RF energy. Control of the passive elements is achieved using switches and various selectable impedance elements. A portion of the re-radiated energy from the passive elements is picked up by the active antenna, and the phase with which the re-radiated energy is received by the active antenna is controllable.

SUMMARY OF THE INVENTION

One aspect of the present invention is directed towards enhancing transmission and reception characteristics of wireless electronic devices. According to certain principles of the present invention, a wireless transceiver assembly can include passive and active elements positioned with respect to an optional backplane to enhance directional transmission and reception of RF (Radio Frequency) signals.

More specifically, a transceiver assembly for transmitting and/or receiving wireless signals can support beamforming techniques to enhance reliability of a portable cellular device. In an illustrative embodiment, the assembly includes an active antenna element positioned in relation to a backplane. The active antenna transmits and/or receives RF (Radio Frequency) signals. At least one passive antenna element can be disposed in relation to the backplane and active antenna element that transmits or receives wireless signals. Characteristics of the at least one passive antenna can be adjusted to reflect RF signals. Consequently, an input/output beam pattern of the transceiver assembly can be electronically controlled.

In a specific embodiment, the active antenna element is positioned substantially parallel or angled up to 60 degrees with respect to a backplane that reflects the RF signals.

Settings of the at least one passive antenna element can be adjusted to vary an input/output beam pattern produced by a combination of backplane, active antenna element and at least one passive antenna element. More specifically, the at least one passive antenna element can be set to a reflective or transmissive mode to change characteristics such as directivity and angular beamwidth of an input/output beam pattern of the transceiver assembly. Consequently, an input/output beam pattern of the cellular device can be more easily directed towards a specific target receiver such as a base station, reducing signal to noise interference levels and increasing a gain of the corresponding antenna device.

In a specific application, the backplane is disposed in a flip-top type earpiece of a portable cellular telephone device. In yet another application, use of the backplane on a cell phone is optional. For example, the antenna assembly can include an active antenna element and passive elements without a reflective backplane.

When the passive antenna device is set to a reflective mode, incident RF signals are generally reflected. Conversely, when in a transmissive mode, the passive antenna element allows RF signals to pass relatively unattenuated. In the latter mode, RF signals are minimally redirected or reflected by the passive antenna element.

Based on a positioning of the backplane, an RF signal received from a base station can be reflected off the backplane to the active antenna that receives the signal. As briefly mentioned above, the passive antenna elements can also reflect a received signal to the active antenna for better reception when they are set to a reflective mode. Strength of the received signal at the active antenna element is enhanced because the actual received RF signal is a summation of directly received RF energy and reflected RF energy from the backplane and passive antenna elements.

Settings of the at least one passive antenna element, and the input/output beam pattern can therefore be adjusted to account for changing orientation of a person using a corresponding mobile or cellular phone device.

Characteristics of one or more passive antennas can be adjusted using weighted control signals. That is, the at least one passive antenna element can be controlled to be more or less reflective or transmissive depending on a weighted control signal driving the corresponding passive antenna element. Accordingly, an input/output beam of the transceiver assembly can be selectively multiplexed or controlled to support beamsteering in almost any direction. The input/output beam pattern also can be scanned to find an optimal setting for transmitting to or receiving from a transceiver device located in a particular direction with respect to a user.

In one application, the at least one passive antenna element includes two passive antenna elements, each of which can be selectively set to a transmissive or reflective mode. The number of passive antenna elements can vary depending on the application.

An active antenna element can be positioned in-line or offset with respect to the two or more passive antenna elements. Additionally, a lengthwise portion of the passive antenna elements can be positioned substantially parallel with each other so that a combination of the antenna elements are disposed parallel or at an acceptably small angle such as less than 60 degrees with respect to the backplane. In one application, the backplane is positioned between 10 and 60 degrees with respect to the active antenna element.

Typically, the at least one passive antenna element and active antenna element are positioned to lie in a common plane that is itself parallel or disposed at an angle less than 45 or 60 degrees with respect to the backplane. However, the degree to which the passive and active elements lie in a common plane can vary depending on the application.

Spacing of the active antenna element and at least one passive antenna with respect to each other also can vary depending on the application. For example, the at least one passive antenna element can be positioned about a quarter-wavelength from the active antenna element to enhance beamsteering capabilities. Spacing between the active and at least one passive antenna element can be around 0.5 and 1.5 inches for use in certain compact portable cellular devices, even though such a spacing is greater or smaller than a quarter-wavelength of a corresponding carrier frequency of the transmitted and received RF signals.

In one application, the spacing between a passive antenna element and active antenna element is two inches or less. Typically, smaller spacings are used in conjunction with higher operating frequencies.

The techniques of the present invention offer advantages over the prior art. For example, a combination of active antenna element and at least one passive antenna element can be employed to adjust directionality, gain and angular beamwidth of an input/output beam pattern. These few components can be easily assembled into a compact cellular device such as a portable telephone. Consequently, a compact cellular device including such a transceiver assembly can cost less to manufacture than alternative antenna devices, yet provide the benefits of reduced interference and fading not otherwise achieved using only a standard active element for transmitting and receiving RF signals. Use of a backplane in relation to the active antenna element can also enhance directionality.

Another benefit of supporting beamforming according to the principles of the present invention is the ability to more optimally communicate with a target such as a base station. Since directionality and gain control of an input/output pattern of a portable device supports reduced power output, a user positioned behind the backplane can be exposed to less radiation than if higher power output levels were used to transmit the same information to a target base station. Overall power consumption is also reduced since a lower power beam is necessary to transmit to a target receiver.

Use of a movable backplane with respect to active and passive antenna elements enables manufacturers to reduce the size of antenna devices for transmitting and receiving RF signals. For example, a form factor associated with an antenna assembly of a mobile phone device or handheld wireless device can be reduced even though the transceiver assembly provides enhanced transmission and reception capabilities.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

A description of preferred embodiments of the invention follows.

Figure 1:
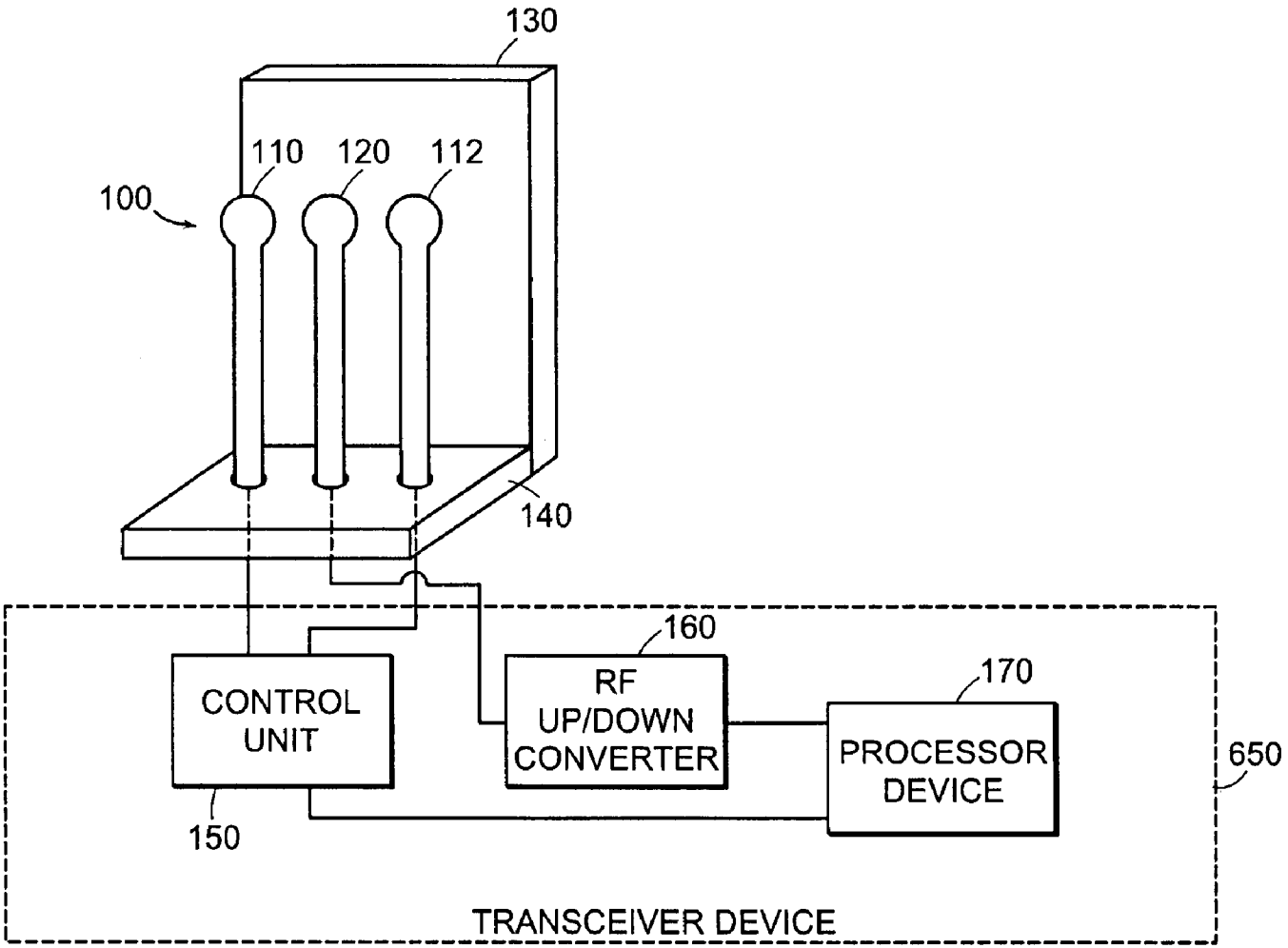
FIG. 1 is a block diagram and partial perspective view of an antenna device.

FIG. 1 is a block diagram and partial perspective view of antenna device 100 according to certain principles of a preferred embodiment. As shown, active antenna element 120 is disposed between passive antenna element 110 and passive antenna element 112. Both active antenna element 120 and passive antenna elements 110 and 112 are disposed on a similar side of backplane 130. In this embodiment, both active antenna element 120 and passive antenna elements 110 and 112 are fixed to base plane 140.

However, antenna device 100 can be fabricated so that some or all of the antenna elements are retractable or foldable for easy stowing. For example, some or all of the antenna elements can be automatically, manually, electronically or mechanically adjusted so that a corresponding device including antenna device 100 is compact when not in use, yet still functional when open and in use. Consequently, antenna elements can be protected from damage during non-use. Additionally, the antenna elements are optionally movable with respect to each other so that they can be adjusted to support more efficient communication.

Although all of the antenna elements, namely, active antenna element 120 and passive antenna elements 110 and 112, are shown disposed substantially in a common plane which is parallel to backplane 130, actual positioning of these elements can vary depending on the application. For example, active element 120 and passive elements 110 and 112 need not be positioned in a common plane.

It also should be noted that multiple active antennas can be used in lieu of a single active antenna.

The antenna elements are preferably spaced a quarter-wavelength apart from one another. More specifically, passive antenna element 110 can be spaced one quarter-wavelength from active antenna element 120. Similarly, passive antenna element 112 can be spaced one quarter-wavelength from active antenna element 120. This spacing can enhance reception and transmission of RF signals at active antenna element 120. Positioning of active antenna element 120 between passive antenna elements 110 or 112 is beneficial because it enables a wide lattitude in controlling a corresponding input/output beam pattern.

The backplane 130 can be contoured or shaped other than flat so that it is not necessarily a planar surface. Consequently, active antenna element 120 and passive antenna elements 110 and 112 do not necessarily have to lie in a common plane, nor must they be perpendicular to backplane 130.

Passive antenna elements 110 and 112 are optionally spaced more or less than a quarter-wavelength from active antenna element 120. For example, passive antenna element 110 can be spaced 0.5 to 1.5 inches from active antenna element 120 in a cellular phone application that operates at or around 2.4 MHz (MegaHertz). Likewise, passive antenna element 112 can be spaced 0.5 to 1.5 inches from active antenna element 120. Although a spacing of antenna elements may be less than a quarter-wavelength of a carrier frequency at which antenna device 100 transmits and receives RF signals, antenna device 100 can still communicate effectively with a target transceiver such as a base station supporting wireless digital communications. For example, the spacing can be less than 2 inches when supporting higher operating frequencies.

Active antenna element 120 can be spaced a quarter-wavelength from backplane 130. Similarly, passive antenna elements 130 can be spaced a quarter-wavelength from backplane 130. However, spacing of passive antenna elements 110 and 112 also can vary depending on the application.

Active antenna element 120 is optionally a half dipole antenna or other omni-directional antenna device that generates an RF (Radio Frequency) signal axially outward in all directions. During operation, however, a portion of the RF signal generated by active antenna element 120 reflects off backplane 130 so that a majority of the incident signal is redirected or reflected away from backplane 130 generally in the opposite direction. The overall RF signal transmitted from antenna device 100 is therefore intensified in a particular direction because the RF energy reflecting off backplane 130 superimposes with the RF energy originally transmitted outward from active antenna element 120 away from backplane 130. Antenna device 100 is therefore at least somewhat directional even without passive antenna elements 110 and 112. The addition of passive antenna elements 110 and 112 enhances control of the input/output beam pattern.

Conversely, the intensity of an RF signal received at antenna device 100 can be amplified. For example, a portion of an incident RF directed to antenna device 100 wave would be directly received by active antenna element 120. Additional portions of the incident RF signal can be reflected off backplane 130 and passive antenna elements 110 and 112 to active antenna element 120, resulting in a stronger received signal. The result is better reception and more reliable communication of data information. Backplane 130 is optionally replaced by one or more multiple passive antenna elements resulting in the same intensified reception or transmission of an RF signal.

It should be noted that active antenna element 120 also can be a directional antenna device depending on the application. For example, antenna element 120 can have a primary lobe pattern that transmits RF energy in an opposite direction of backplane 120. Passive antenna elements 110 and 120 also can be used to reflect RF energy to adjust an a input/output beam pattern.

Generally, characteristics of passive antenna elements 110 and 112 are adjusted by control unit 150 to further control the directivity of a generated RF signal. For example, control unit 150 can selectively apply weighting factors to each of passive antenna elements 110 and 112 to adjust a degree to which they are reflective or transmissive. Based on a selected weighting, corresponding characteristics of a passive antenna elements 110 and 112 can be individually adjusted so they are more or less reflective.

A resolution of reflectivity of a passive antenna depends on circuitry used to tune passive antenna elements 110 and 112. This will be discussed in more detail later in this specification.

Processing device 170 is coupled to RF up/down converter 160, which in turn transmits and receives RF signals over active antenna element 120. Antenna device 100 is optionally unidirectional instead of bidirectional.

Techniques can be employed to determine an optimal direction and angular beamwidth for transmitting and receiving signals such as encoded digital packets on antenna device 100. In a specific application, a relative positioning of antenna device 100 with respect to a target device such as a base station can be determined. Based on desired settings and a direction that an input/output beam pattern is to be generated, processing device 170 interfaced with control unit 150 selectively adjusts characteristics of passive antenna elements 110 and 112 to transmit to or receive from a target device in a particular direction. Orientation of antenna device 100 and its location can be taken into account when transmitting or receiving an RF signal.

In addition to its relative positioning with respect to backplane 130 as mentioned, passive antenna elements 110 and 112 can be set to adjust the input/output beam pattern of antenna device 100. For example, when either passive antenna element is set to the reflective mode, incident RF signals to the corresponding passive antenna element are scattered or reflected in an opposite direction. Conversely, RF signals propagate through passive element 110 or 112 when a corresponding passive antenna element is set to the transmissive mode. Accordingly, characteristics of an in input/output beam pattern can be dynamically adjusted for more optimally receiving or transmitting RF signals.

Figure 2A:
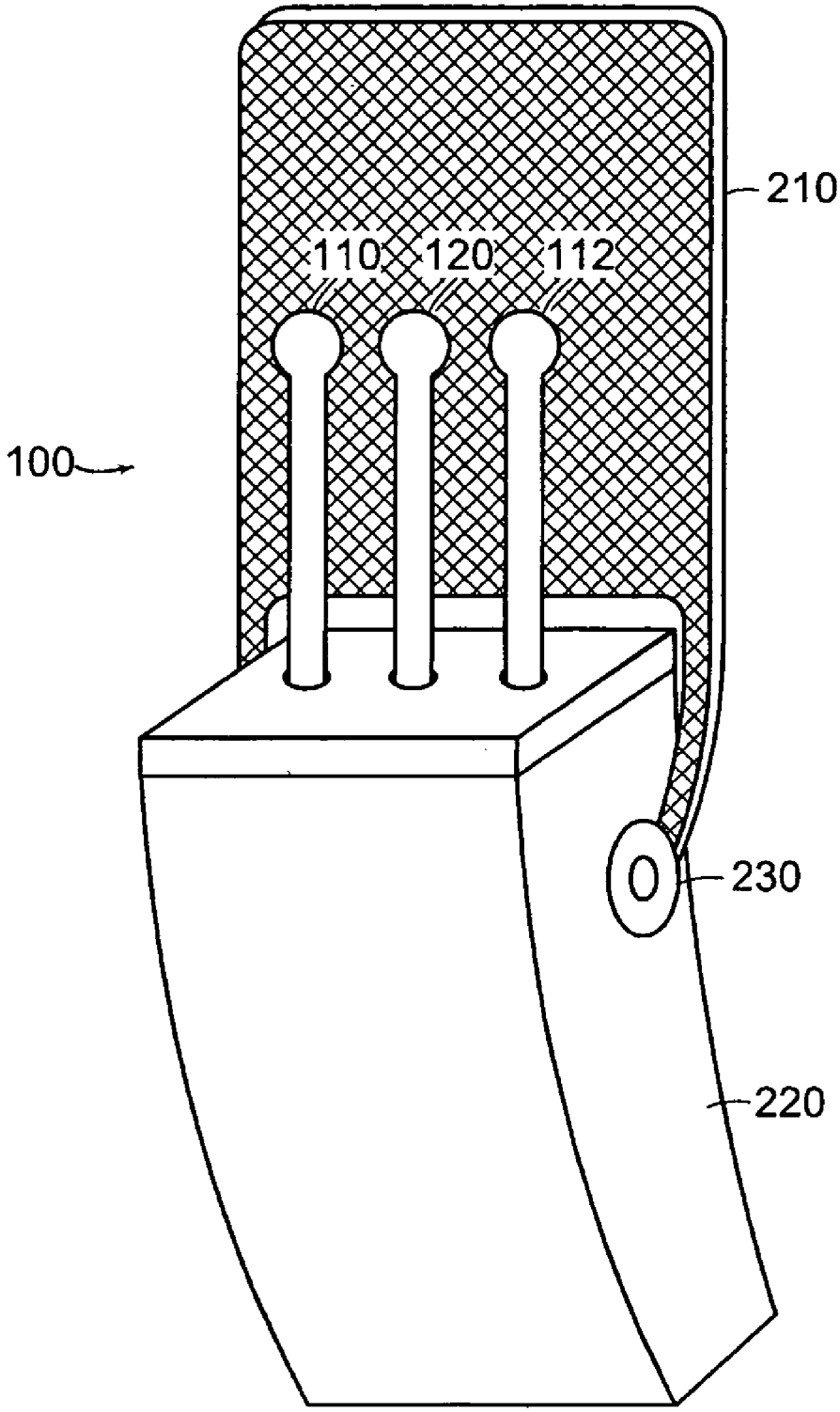
FIG. 2A is a perspective view of an antenna device incorporated in a handheld device.

FIG. 2A is a perspective view of a cellular phone device including an adjustable antenna device according to certain principles of the present invention. As shown, active antenna element 120 is positioned at an end of cellular telephone device 220. Passive antenna elements 110 and 112 can be disposed so that one passive antenna element is positioned on each side of active antenna element 120.

Flip-top ear speaker 210 disposed on hinge 230 enables a user to open cell phone 220 and make a telephone call. Thus, flip-top speaker can include a movable backplane 130 tied to ground so that it reflects RF signals.

When phone 220 is not in use, flip-top ear speaker 210 can be closed so that flip-top speaker 210 is in contact with body of phone 220 so it is more compact to carry. Even while in a closed position, settings of passive antenna elements 110 and 112 can be adjusted to receive an RF signal such as an indication of a pending phone call.

Figure 2B:
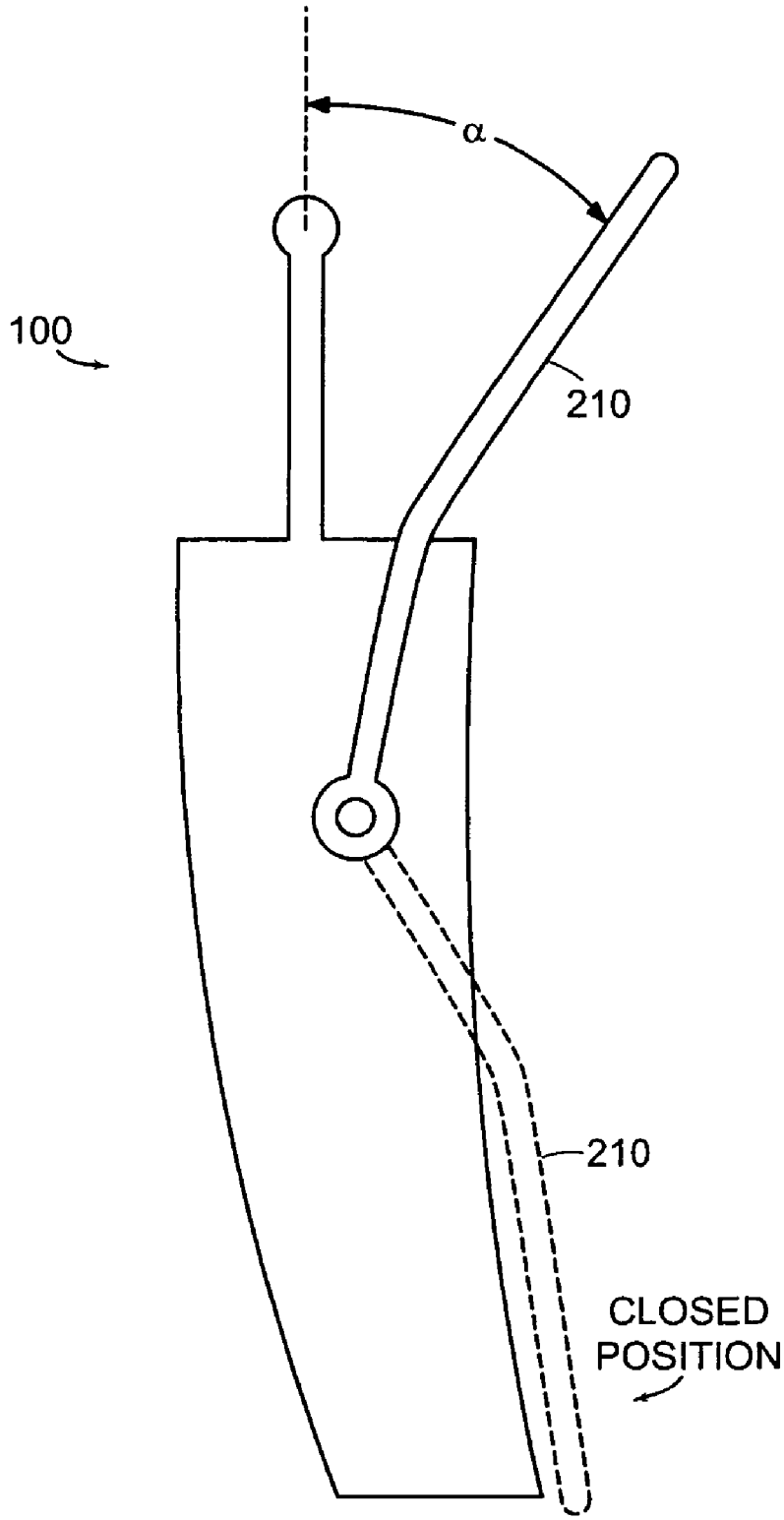
FIG. 2B is a side view of an antenna device incorporated in a handheld device.

During use, cell phone 220 and, more specifically, backplane 130 disposed in flip-top ear speaker 210, reflects RF radiation away from a users head. An angular position of backplane 130 in ear speaker 210 typically can vary between zero and sixty degrees. That is, active antenna element 120 and passive antenna element 110 and 112 can be positioned to be parallel or angled up to sixty degrees with respect to backplane 130. In certain applications, active antenna element 120 and passive antenna elements 110 and 112 can be disposed so they are more than 60 degrees with respect to backplane 130. The angle, $\alpha$, between antenna elements and backplane 130 is more particularly shown in FIG. 2B, illustrating a side view of cell phone 220.

In one embodiment as mentioned, cell phone 220 does not include a backplane. Passive antenna elements 110 and 112 are adjusted to change an input/output beam pattern. Additional passive antenna elements can be disposed on phone 220 to support additional directionality. Specifically, one or more passive antenna elements can be disposed in place of previously discussed backplane 130. In this instance, however, reflections off the additional passive antenna are electronically controllable. Similar to use of backplane 130, one or more passive antenna elements can be used to steer or reflect an RF beam away from a users head.

Figure 3:
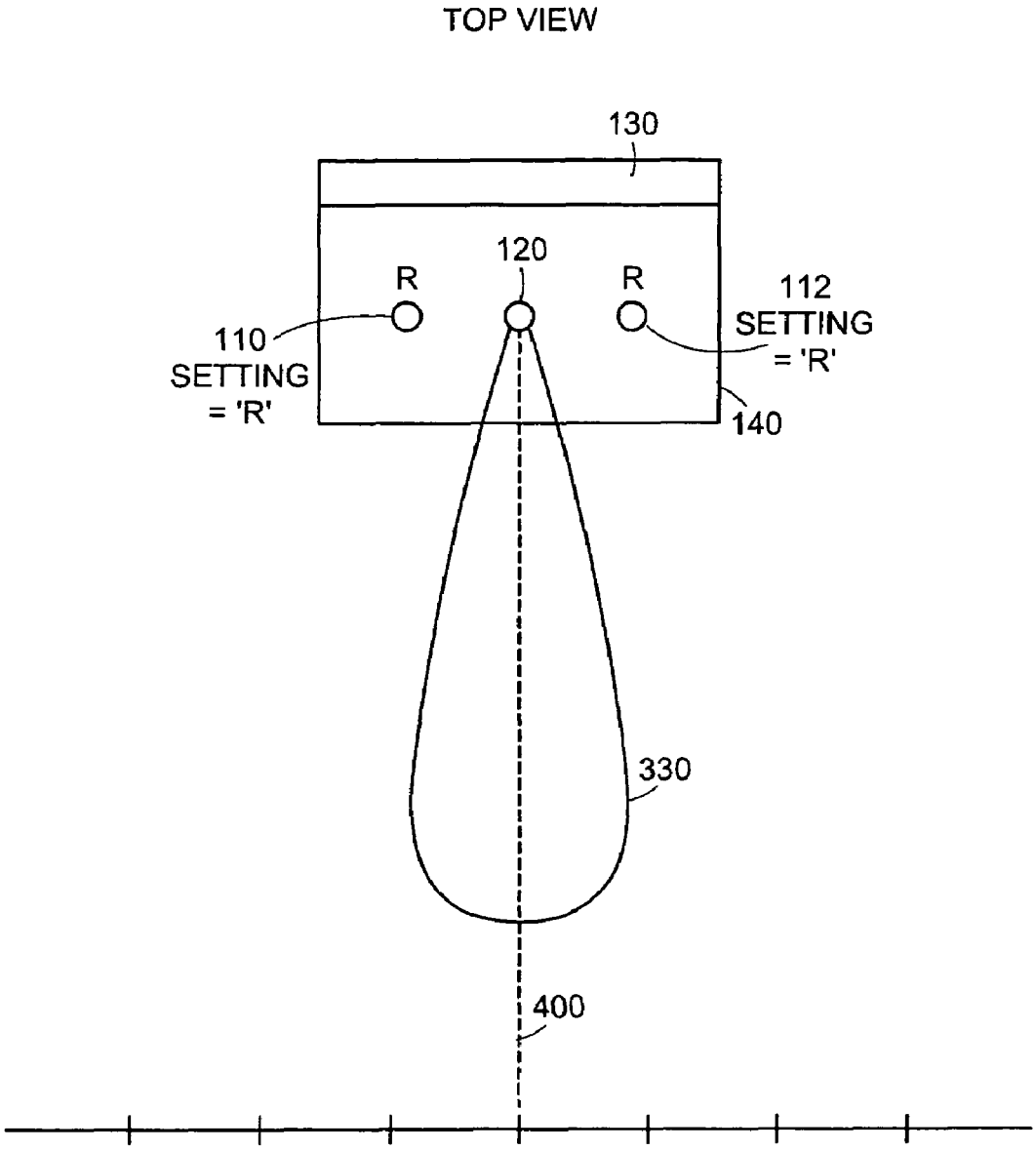
FIG. 3 is a top view of an input/output beam pattern formed when both passive antenna elements in the antenna device are set to a reflective mode.

FIG. 3 is a top view looking axially down onto the antenna elements illustrating an input/output beam pattern 330 for receiving or transmitting RF signals according to certain principles of the present invention. As shown, both passive antenna elements 110 and 112 are set to a reflective mode. As a result, antenna device 100 generates a narrow lobe pattern approximately centered along axis 400 for transmitting or receiving RF signals.

Figure 4:
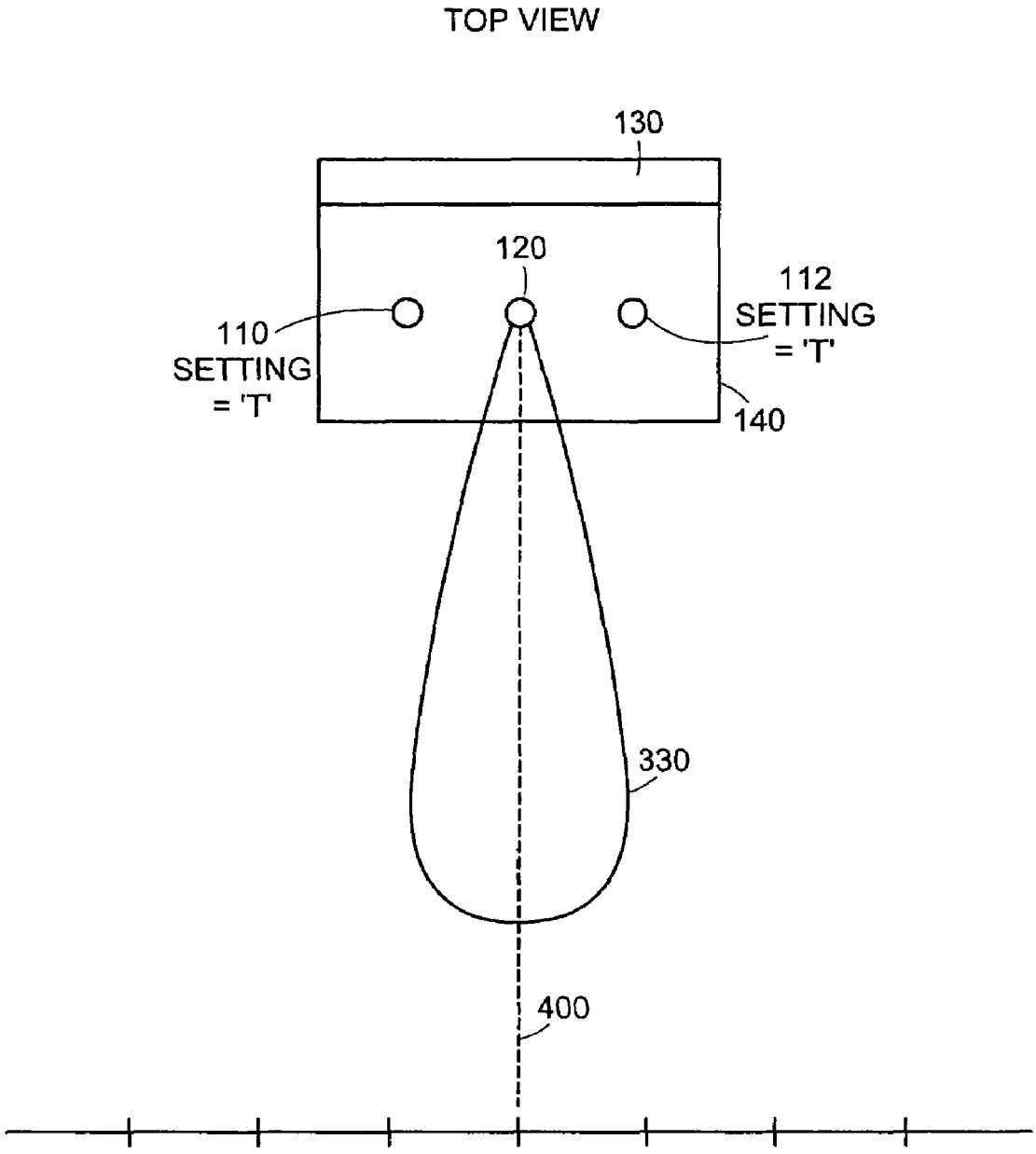
FIG. 4 is a top view of an input/output beam pattern formed when both passive antenna elements in the antenna device are set to a transmissive mode.

FIG. 4 is a top view looking axially down onto the antenna elements illustrating an input/output beam pattern 330 for receiving or transmitting RF signals according to certain principles of the present invention. As shown, both passive antenna elements 110 and 112 are set to a transmissive mode. Consequently, antenna device 100 generates a wider lobe pattern centered along axis 400 for transmitting or receiving RF signals than if passive elements 110 and 112 were set to the reflective mode.

Figure 5:
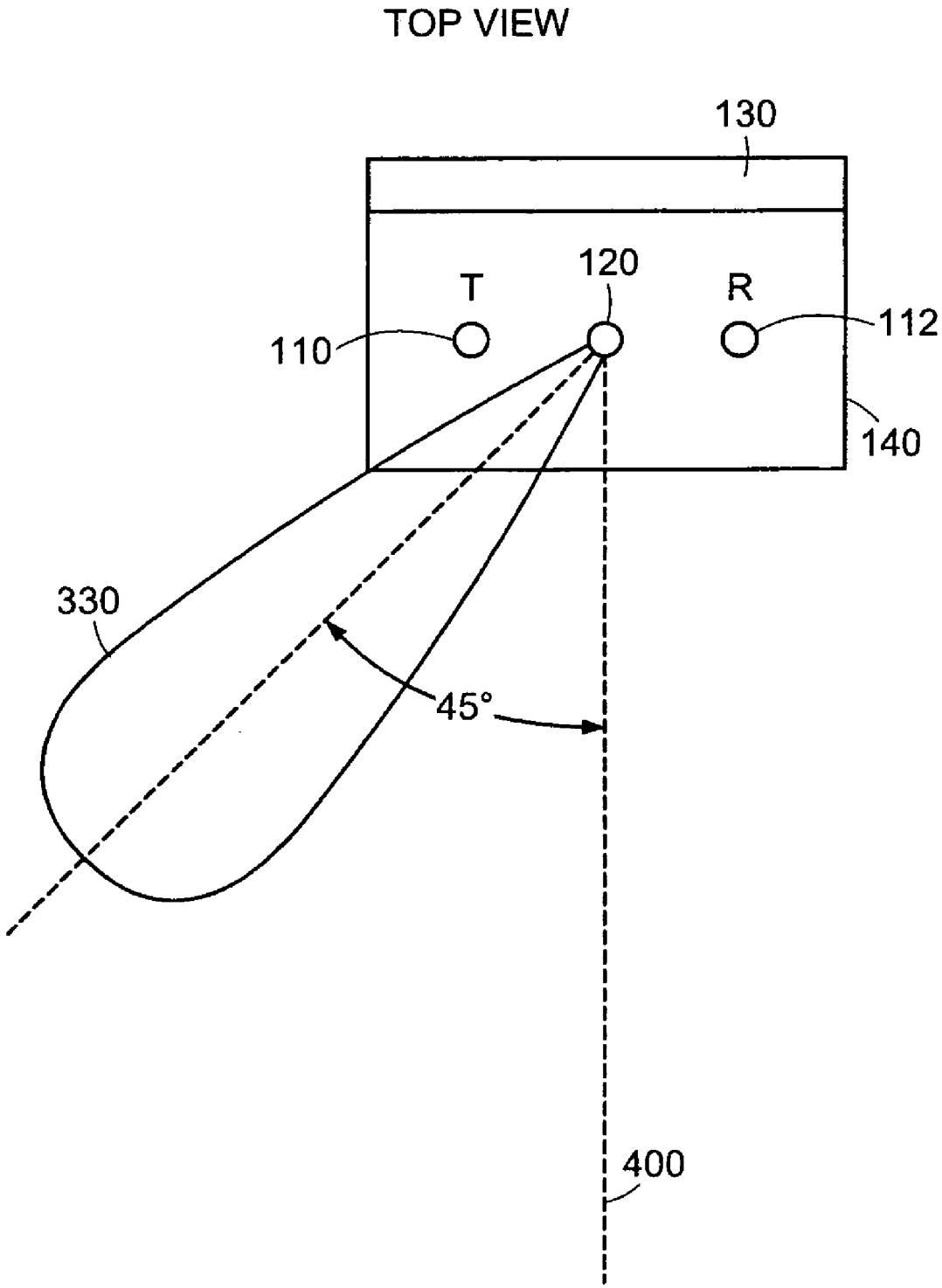
FIG. 5 is a top view of an input/output beam pattern formed when one passive antenna device is set to a reflective mode and one passive antenna element is set to a transmissive mode.

FIG. 5 is a top view looking axially down onto the antenna elements illustrating an input/output beam pattern 330 for receiving or transmitting RF signals according to certain principles of the present invention. As shown, passive antenna element 110 is set to the transmissive mode and passive antenna element 112 is set to the reflective mode. Consequently, antenna device 100 generates an input/output beam 330 or lobe pattern that is angled approximately 45 degrees with respect to axis 400 for transmitting or receiving RF signals. The series of FIGS. 3, 4 and 5 illustrate how an input/output beam pattern from antenna device 100 can be directed to a target transceiver such as a base station. Additionally, the figures illustrate how input/output beam 330 can be narrowed or widened.

Figure 6:
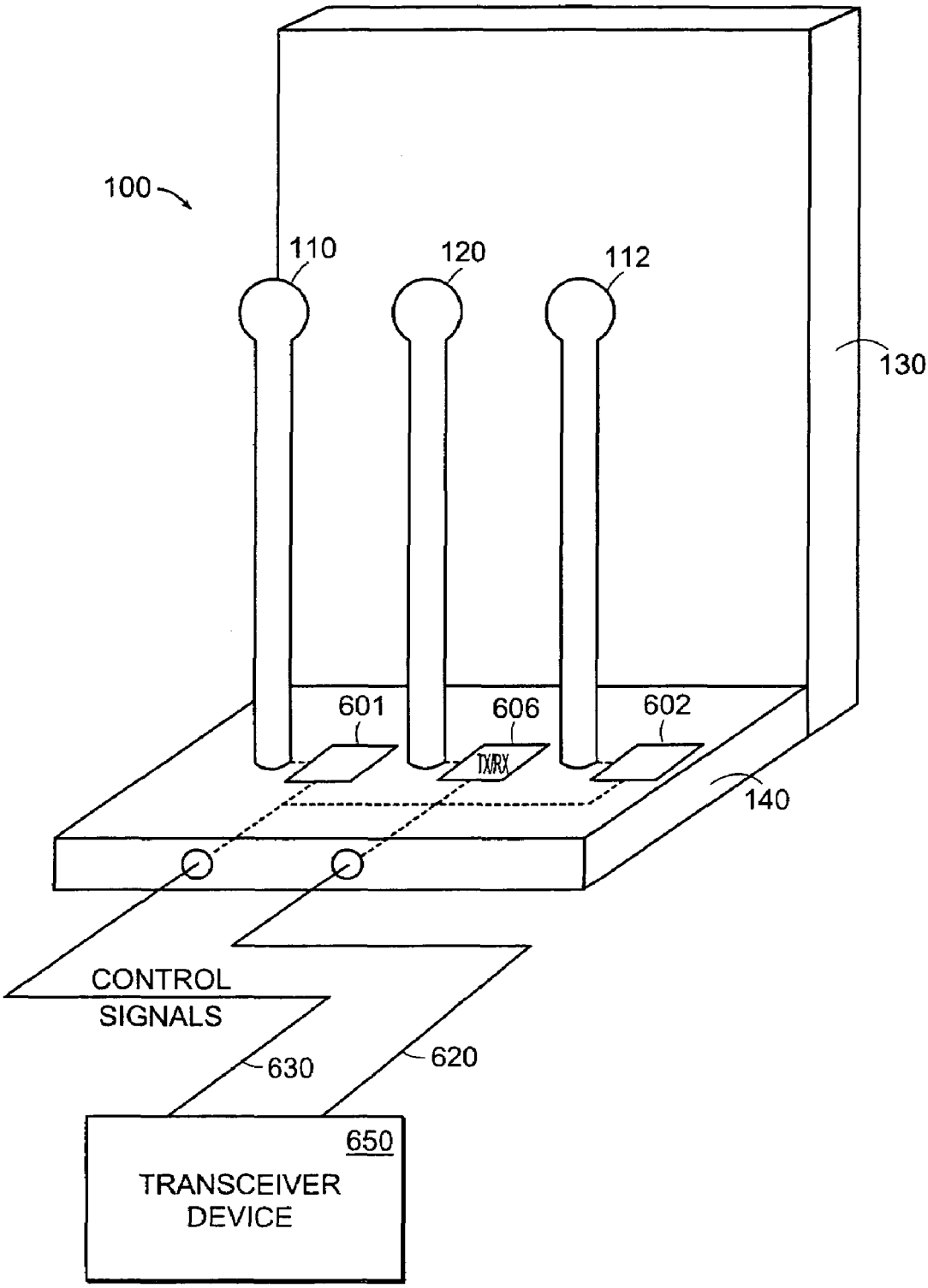
FIG. 6 is a block diagram and partial perspective view of a more detailed antenna device.

FIG. 6 is a block diagram and partial perspective view of a more detailed antenna device according to one embodiment.

As mentioned, passive antenna elements 110 and 112 are selectably operated in one of two modes: reflective mode and transmissive mode. Processor 170 and control unit 150 provides the control signal to set passive antenna elements 110 and 112. A degree to which passive antenna elements 110 and 112 are reflective or transmissive can also vary so that input/output beam can be precisely steered in many different directions.

In the reflective mode, passive antenna elements 110 and 112 are effectively elongated by being inductively coupled to ground. In the transmissive mode, passive antenna elements 110 and 112 are effectively shortened by being capacitively coupled to ground. The direction of a beam steered by antenna device 100, therefore, can be determined by knowing which passive antenna elements are in reflective mode and which are in transmissive mode. Generally, the direction of an input/output beam pattern extends to/from active antenna element 120, projecting past the passive antenna elements in transmissive mode and away from the passive antenna elements in reflective mode.

Antenna device 100 can include base plane 140 upon which the two passive antenna elements 110 and 112 and active antenna element 120 are mounted. Base plane 140 also can include adjustable impedance components 601 and 602.

During operation of antenna device 100, selectable impedance components 601 and 602 associated with a corresponding passive antenna element are independently adjusted to effect the directionality of signals to be transmitted and/or received to or from transceiver device 650. By properly adjusting the phase for each passive antenna element during signal transmission from active antenna element 120, a composite beam is formed that may be positionally directed towards a target. That is, the optimal phase setting for transmitting a wireless signal such as a CDMA (Code Division Multiple Access) signal from antenna device 100 is established using an appropriate phase setting for each passive antenna element 110 and 112 that re-radiates RF energy to create a directional reverse link signal. The result is an antenna device 100 that directs a stronger reverse link signal pattern in the direction of the intended target such as a base station receiver.

Phase settings used for re-radiating RF energy of transmission signals also cause passive antenna elements 110 and 112 and active antenna element 120 to optimally receive forward link signals that are transmitted from a base station. Due to the programmable nature and the independent phase setting of each passive antenna element, only forward link signals arriving from a direction that are more or less in the location of the base station are optimally received. The passive antenna elements naturally reject other signals that are not transmitted from a similar location as are the forward link signals. In other words, a directional antenna beam is formed by independently adjusting the phase of each passive antenna element. This form of isolation can reduce interference among multiple users sharing limited wireless bandwidth. Multipath fading also can be reduced suing this technique.

The selectable impedance components shift the phase of the reverse link signal in a manner consistent with re-radiating RF energy by an impedance setting associated with that particular selectable impedance component, respectively, as set by an impedance control input 630. In one embodiment, the impedance control input 730 is provided over a number of lines equal to the number of passive antenna elements, five, multiplied by the number of impedance states minus one for each of the selectable impedance components 601 and 602. For example, if the selectable impedance components 601 and 602 have two states, then there are two lines. Alternatively, a serial encoding method of the states may be employed to reduce the number of control lines. Decode circuitry disposed on base plane 140 can be used to decode control commands.

By shifting the phase of the re-radiated RF energy of a transmitted signal from each passive element 110 and 112, certain portions of the transmitted signal will be more in phase with other portions of the transmitted signal. In this manner, portions of signals that are more in phase with each other will combine to form a stronger composite beam. The amount of phase shift provided to each antenna element 110 and 112 through the use of selectable impedance components 601 and 602, respectively, determines the direction in which the stronger composite beam will be transmitted, as described above in terms of reflectance and transmittance.

The phase settings, provided by the selectable impedance components 601 and 602, used for re-radiating RF signals from each passive antenna element 110 and 112 as noted above provide a similar physical effect on a forward link frequency signal that is received from a base station or other transmitting device. That is, as each passive antenna element 110 and 112 re-radiates RF energy of a signal received from the base station to active antenna element 120. Respective received signals will initially be out of phase with each other due to the location of each passive antenna element 110 and 112 an the base plane 140. However, each received signal is phase-adjusted by the selectable impedance components 601 and 602. The adjustment brings each signal in phase with the other re-radiated signals. Accordingly, when each signal is received by the active antenna element 120, a composite received signal at active antenna element 120 will be more accurate and strong in the direction of the base station.

The selectable impedance components 601 and 602 control values are provided by the controller 150 (FIG. 1) to optimally set the impedance for each selectable impedance component 601 and 602 in antenna device 100,. Generally, in the preferred embodiment, control unit 150 determines these optimum impedance settings during idle periods when transceiver device 650 is neither transmitting nor receiving data via antenna device 100. During this time, a received signal such as a forward link pilot signal is continuously sent from a base station is received on each passive antenna element 110 and 112 and active antenna element 120. During idle periods, the selectable impedance components can be adjusted to optimize reception of a pilot signal from a base station, such as by maximizing the received signal energy or other link quality metric.

Processor 170 determines an optimal phase setting for each passive antenna element 110 and 112 based on reception of a current pilot signal. Processor 170 then provides and sets the optimal impedance for each selectable impedance component 601 and 602. When the antenna device 100 enters an active mode for transmission or reception of signals between the base station and transceiver device 650, the impedance settings of the adjustable impedance components 601 and 602 remain as set during the previous idle time period.

Before a detailed description of phase (i.e. impedance) setting computation as performed by processor 170 is given, it should again be understood that the principles of the present invention are based in part on the observation that the location of the base station in relation to any one mobile subscriber unit (i.e., transceiver device 650) is approximately circumferential in nature. That is, if a circle were drawn around a mobile subscriber unit and different locations are assumed to have a minimum of one degree of granularity between any two locations, a base station can be located at any of a number of different possible angular locations. Assuming accuracy to one degree, for example, there are 360 different possible phase setting combinations that exist for antenna device 100. Each phase setting combination can be thought of as a set of two impedance values, one for each selectable impedance component 601 and 602 electrically connected to respective passive antenna elements 110 and 112.

There are, in general, at least two different approaches to finding the optimized impedance values. In the first approach, control unit 150 performs a type of optimized search in which all possible impedance setting combinations are tested. For each impedance setting (in this case, for each one of multiple angular settings), two precalculated impedance values are read, such as from memory storage locations in the control unit 150, and then applied to the respective selectable impedance components 601 and 602. The response at a receiver is then detected by the control unit 150. After testing all possible angles, the one having the best receiver response, such as measured by maximum signal to noise ratio (e.g., the ratio of energy per bit, $E_b$, or energy per chip, $E_c$, to total interference, $I_o$), can be used to transmit or receive an RF signal.

In a second approach, each impedance value is individually determined by allowing it to vary while the other impedance values are held constant. This perturbational approach iteratively derives an optimum value for each of the two impedance settings.

Figure 7:
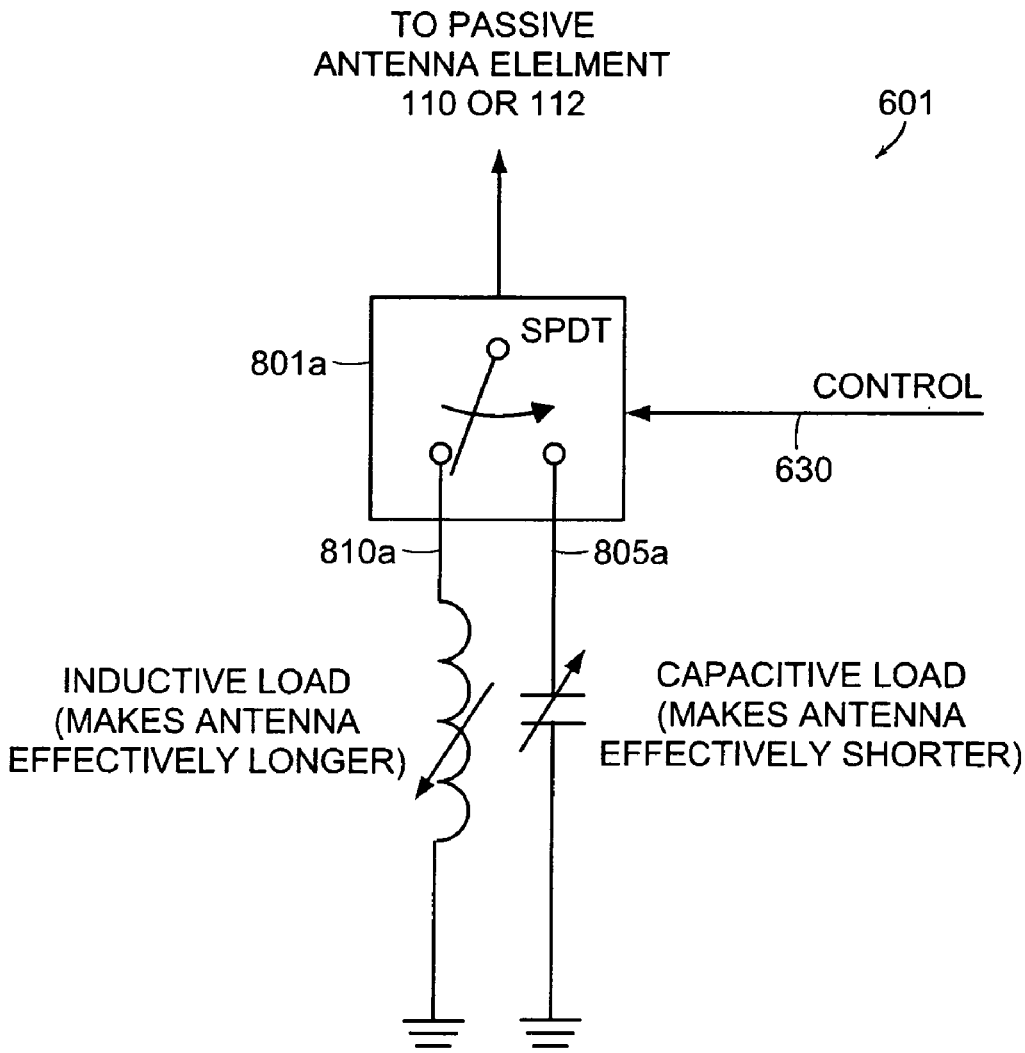
FIG. 7 is a block diagram of a selectively controlled impedance component.

FIG. 7 is an embodiment of the selective impedance component 601 coupled to its respective passive antenna element 110. The selectable impedance component 601 includes a switch 801*a*, capacitive load 805*a*, and inductive load 810*a*. Both the capacitive load 805*a* and inductive load 810*a* are connected to a ground plane, as shown.

Switch 801*a* is a single-pole, double-throw switch controlled by a signal on control line 630. When the signal on the control line 630 is in a first state (e.g., digital 'one'), switch 801*a* electrically couples passive antenna element 110 to the capacitive load 805*a*. The capacitive load makes the passive antenna element 110 effectively shorter. When the signal on the control line 630 is in a second state (e.g., digital 'zero'), switch 801*a* electrically couples passive antenna element 110 to inductive load 810*a*, which makes passive antenna element 110 effectively taller, and, therefore, reflective.

Figure 8:
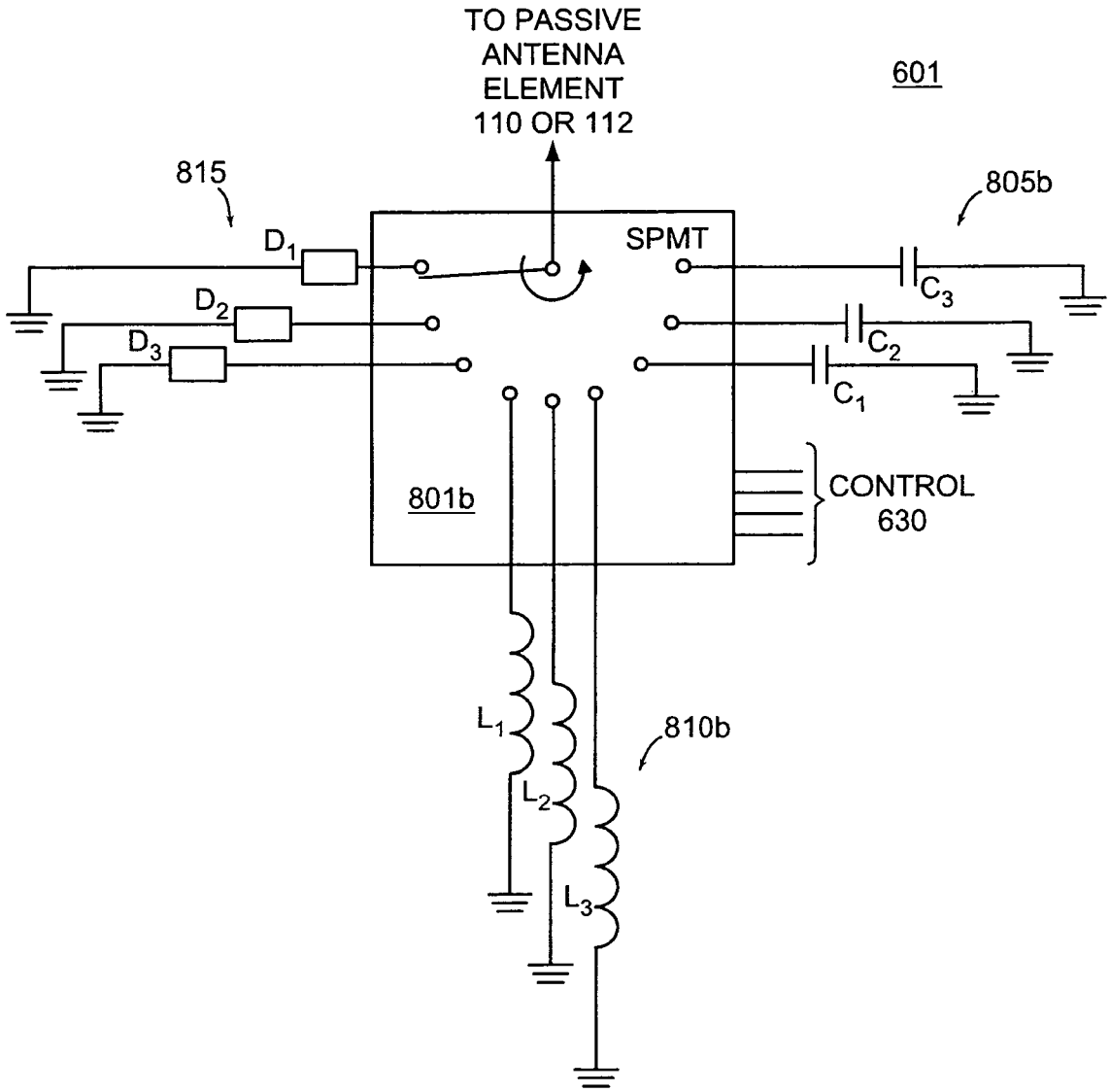
FIG. 8 is a block diagram of a selectively controlled impedance component.

FIG. 8 is an alternative embodiment of the selectable impedance component 601 coupled to its respective passive antenna element 110. In this embodiment, selectable impedance component 601 includes a SPMT (Single Pole, Multiple Throw) switch 801*b* connected to several different values of discrete impedance components.

Switch 801*b* is a single-pole, multi-throw switch controlled by binary-coded decimal (BCD) signals on four control lines 630. The signal on the four control lines 630 command a pole 803 of the switch 801*b* to electrically connect the passive antenna element 110 to 1-of- up to 16 different impedance components. As shown, there are nine impedance components provided for coupling to passive antenna element 110, but this can be expanded.

Selectable impedance components can include capacitive elements 805*b*, inductive elements 810*b*, and delay line elements 815. Each of the impedance components is electrically disposed between the switch 801*b* and a ground plane.

In this embodiment, capacitive elements 805*b* include three capacitors: $C_1$, $C_2$, and $C_3$. Each capacitor has a different capacitance to cause passive antenna element 110 to have a different transmissibility when connected to passive antenna element 110. For example, capacitive elements 805*b* may be an order of magnitude apart in capacitance value from one another.

Similarly, inductive elements 810*b* can include three inductors: $L_1$, $L_2$, and $L_3$. The inductive elements 810*b* may have inductance values an order of magnitude apart from one another to provide different reflectivities for passive antenna element 110 when connected to the passive element 110.

Delay line elements 815 can include three different values: $D_1$, $D_2$, and $D_3$. Delay line elements 815 may be sized to create a phase shift of the signal re-radiated by the passive antenna element 110 in, for example, thirty degree increments.

In an alternative embodiment, switch 801*b* is a double-pole, double-throw switch to provide different combinations of impedances coupled to passive antenna element 110 to provide various combinations of impedances. In this way, passive antenna element 110 can be used to re-radiate RF energy to active antenna element 120 with various phase angles to allow antenna device 100 to provide a directive beam at various angles. In one case, control unit 150 (i)

selects a first impedance combination to provide a receive beam at one angle by antenna device 100, and (ii) provides a second impedance component combination to generate a transmit beam at a second angle by antenna device 100. It should be understood that choosing combinations of selectable impedance components 805*b*, 810*b*, and 815 are made in a similar manner as other selectable impedance components 602 coupled to the other passive antenna elements 112, respectively.

Alternative technology embodiments of switch 801*b* are possible. For example, switch 801*b* can be composed of multiple single-pole, single-throw switches in various combinations. Switch 801*b* may also be composed of solid-state switches, such as GaAs switches or pin diodes controlled in a typical manner. Such a switch may conceivably include selectable impedance component characteristics to eliminate separate impedance or delay line components. Another embodiment includes micro-electro machined switches (MEMS), which act as a mechanical switch, but have very fast response times. Such devices also can have an extremely small profile.

Figure 9:
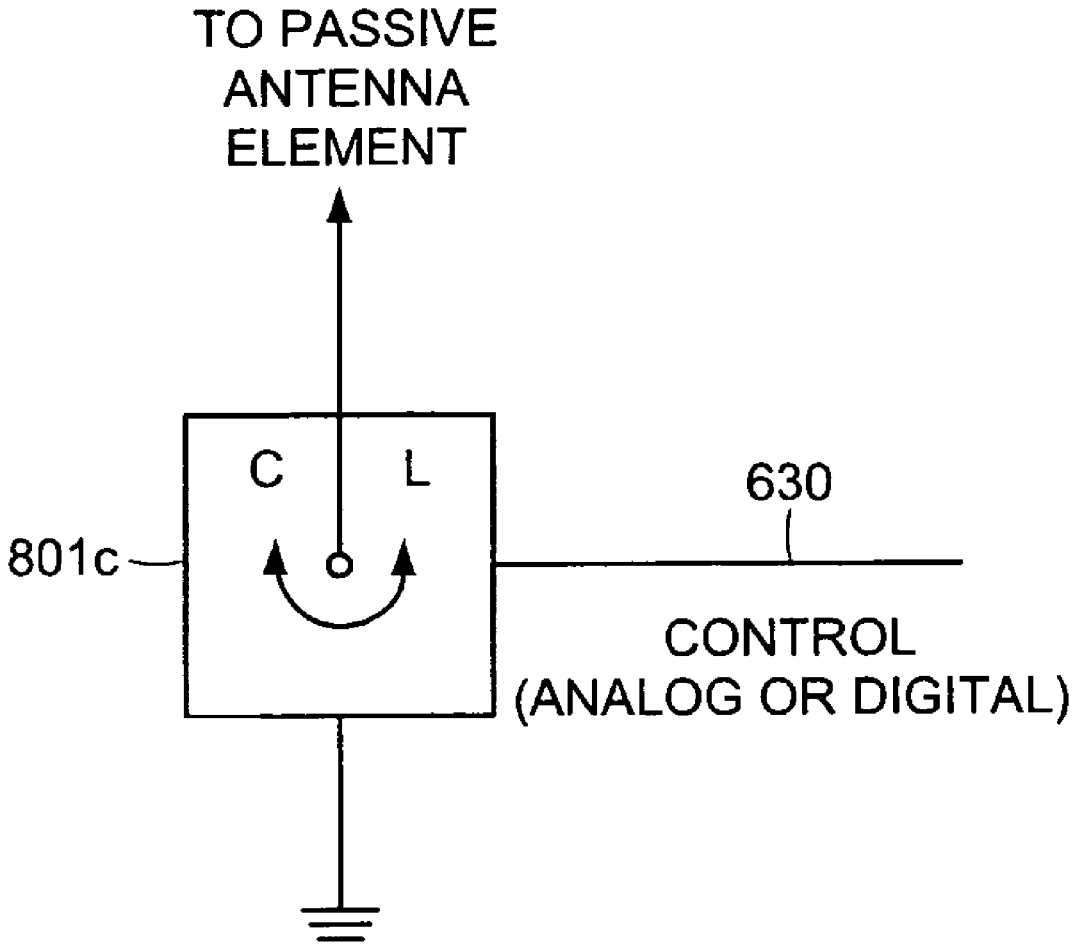
FIG. 9 is a block diagram of a selectively controlled impedance component.

FIG. 9 is yet another alternative embodiment of the selectable impedance component 601 connected to passive antenna element 110. In this embodiment, the selectable impedance component 601 is composed of a varactor 801*c*. The varactor 801*c* is controlled by an analog signal on control line 630. In an alternative embodiment, the varactor 801*c* is controlled by BCD signals on digital control lines. The varactor 801*c* is connected to a ground plane as shown. Varactor 801*c* allows analog-type phase shift selectability to be applied to passive antenna element 601. It should be understood that each passive antenna elements 110 and 112, in this embodiment, are connected to respective varactors to provide virtually infinite phase shifting via the virtually infinite selectable impedance values of the varactors. In this way, the antenna device 100 can provide directive beams in virtually any direction; for example, in one degree increments along a 180 degrees arc of a circle.

While this invention has been particularly shown and described with references to preferred embodiments thereof, it will be understood by those skilled in the art that various changes in form and details may be made therein without departing from the scope of the invention encompassed by the appended claims.

The invention claimed is:

1. An apparatus comprising:

an active antenna element to receive or transmit Radio Frequency (RF) signals, the active antenna element formed as a monopole having a primary axis;

at least one passive antenna element, the passive antenna element formed as a monopole having a primary axis, the active and passive elements disposed such that their respective primary axes are aligned with one another to determine a common antenna element plane which all antenna elements lie and characteristics of the at least one passive antenna element being adjusted to produce an input/output beam pattern for receiving/transmitting the RF signals, a shape of the input/output beam pattern depending on whether the at least one passive antenna element is in a reflective or transmissive state; and a backplane disposed to be aligned with and parallel to the common antenna element plane, such that the antenna elements lie on one side of said backplane, and the backplane further controlling the input/output beam pattern, wherein the at least one passive antenna element includes two passive antenna elements that are each selectably transmissive or reflective.

2. The apparatus as in claim 1, wherein the backplane is disposed in a flip-top type earpiece.

3. The apparatus as in claim 1, wherein characteristics of the at least one passive antenna are selectively adjusted to be reflective or transmissive to support RF beamforming.

4. The apparatus as in claim 1, wherein the active antenna element is positioned between the two passive antenna elements.

5. The apparatus as in claim 4, wherein the active antenna elements and two passive antenna elements are positioned to be substantially parallel with respect to each other, and in the common antenna element plane.

6. The apparatus as in claim 1, wherein the active antenna element and at least one passive antenna element are positioned substantially parallel to the common antenna element plane.

7. The apparatus as in claim 1, wherein the backplane limits RF exposure to a user.

8. The apparatus as in claim 1, wherein characteristics of the two passive antenna elements are controlled to produce a narrower RF beam than otherwise possible without any passive antenna elements.

9. The apparatus as in claim 1, wherein the at least one passive antenna element is positioned up to 2 inches from the active antenna element.

10. The apparatus as in claim 1, wherein the at least one passive antenna element is positioned about a quarter-wavelength of a transmitted or received RF signal from the active antenna element.

11. The apparatus as in claim 1, wherein a first passive antenna element is reflective and a second passive antenna element is reflective to produce a narrower RF beam pattern.

12. The apparatus as in claim 1, wherein the at least one passive antenna element is selectively controlled to adjust a narrowness of the input/output beam pattern.

13. The apparatus as in claim 1, wherein the at least one passive antenna element is selectively controlled to directionally steer the input/output beam pattern.

* * * * *